US006201521B1

(12) United States Patent
Doherty

(10) Patent No.: US 6,201,521 B1
(45) **Date of Patent: *Mar. 13, 2001**

(54) DIVIDED RESET FOR ADDRESSING SPATIAL LIGHT MODULATOR

(75) Inventor: Donald B. Doherty, Richardson, TX (US)

(73) Assignee: Texas Instruments Incorporated, Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/721,862

(22) Filed: Sep. 27, 1996

(51) Int. Cl.[7] ..... G09G 3/34
(52) U.S. Cl. ..... 345/84; 345/103
(58) Field of Search ..... 345/84, 85, 100, 345/94, 98, 99, 56, 48, 87, 103; 348/770, 771, 806, 755

(56) References Cited

U.S. PATENT DOCUMENTS 5,278,652 1/1994 Urbanus et al. .
5,612,713 * 3/1997 Bhuva et al. ..... 345/84
5,657,036 * 8/1997 Markandey et al. ..... 345/85
5,706,123 * 1/1998 Miller et al. ..... 359/291
5,729,245 * 3/1998 Gove et al. ..... 345/84
5,745,088 * 4/1998 Kornher et al. ..... 345/85

* cited by examiner

*Primary Examiner*—Chanh Nguyen
(74) *Attorney, Agent, or Firm*—Charles A. Brill; Wade James Brady, III; Frederick J. Telecky, Jr.

(57) ABSTRACT

A method of implementing pulse-width modulation in a display system (10, 20) that uses a spatial light modulator (SLM) (15). Each frame of data is divided into bit-planes, each bit-plane having one bit of data for each display element of the SLM and representing a bit weight of the intensity value to be displayed by the display elements. Each bit-plane has a display time corresponding to a portion of the frame period, with bit-planes of more significant bits having longer portions. The SLM is divided into reset groups connected to different reset lines (34), so that one reset group can be loaded and its display time begun while the next reset group is loaded. (FIG. 3). Short bit-planes are possible because the display time need not include the time to load the entire array, and for any reset group, its reset can be delayed while other reset groups are loaded.

3 Claims, 5 Drawing Sheets

10
VIDEO IN
12a
SIGNAL I/F
A/D
Y/C SEP
PROCESSOR SYS
FORMAT/ DISPLAY MEMORY
SLM
DISPLAY OPTICS
11
12b
13
14
15
16
TIMING
17

20
IMAGE DATA IN
DIGITAL I/F
PROCESSOR SYS
FORMAT/ DISPLAY MEMORY
SLM
DISPLAY OPTICS
21
13
14
15
16
TIMING
17

DIVIDED RESET FOR ADDRESSING SPATIAL LIGHT MODULATOR

TECHNICAL FIELD OF THE INVENTION

This invention relates to image display systems using spatial light modulators (SLMs), and more particularly to the organization of display elements on the SLM and to methods of addressing display elements of the SLM with data.

BACKGROUND OF THE INVENTION

Video display systems based on spatial light modulators (SLMs) are increasingly being used as an alternative to display systems using cathode ray tubes (CRTs). SLM systems provide high resolution displays without the bulk and power consumption of CRT systems.

Digital micro-mirror devices (DMDs) are a type of SLM, and may be used for either direct-view or projection display applications. A DMD has an array of micro-mechanical display elements, each having a tiny mirror that is individually addressable by an electronic signal. Depending on the state of its addressing signal, each mirror tilts so that it either does or does not reflect light to the image plane. The mirrors may be generally referred to as "display elements", which correspond to the pixels of the image that they generate. Generally, displaying pixel data is accomplished by loading memory cells connected to the display elements. The display elements can maintain their on or off state for controlled display times.

Other SLMs operate on similar principles, with an array of display elements that may emit or reflect light simultaneously, such that a complete image is generated by addressing display elements rather than by scanning a screen. Another example of an SLM is a liquid crystal display (LCD) having individually driven display elements.

To achieve intermediate levels of illumination, between white (on) and black (off), pulse-width modulation (PWM) techniques are used. The basic PWM scheme involves first determining the rate at which images are to be presented to the viewer. This establishes a frame rate and a corresponding frame period. For example, in a standard television system, images are transmitted at 30 frames per second, and each frame lasts for approximately 33.3 milliseconds. Then, the intensity resolution for each pixel is established. In a simple example, and assuming n bits of resolution, the frame time is divided into $2^n$-1 equal time slices. For a 33.3 millisecond frame period and n-bit intensity values, the time slice is $33.3/(2^n-1)$ milliseconds.

Having established these times, for each pixel of each frame, pixel intensities are quantized, such that black is 0 time slices, the intensity level represented by the LSB is 1 time slice, and maximum brightness is $2^n$-1 time slices. Each pixel's quantized intensity determines its on-time during a frame period. Thus, during a frame period, each pixel with a quantized value of more than 0 is on for the number of time slices that correspond to its intensity. The viewer's eye integrates the pixel brightness so that the image appears the same as if it were generated with analog levels of light.

For addressing SLMS, PWM calls for the data to be formatted into "bit-planes," each bit-plane corresponding to a bit weight of the intensity value. Thus, if each pixel's intensity is represented by an n-bit value, each frame of data has n bit-planes. Each bit-plane has a 0 or 1 value for each display element. In the simple PWM example described in the preceding paragraphs, during a frame, each bit-plane is separately loaded and the display elements are addressed according to their associated bit-plane values. For example, the bit-plane representing the LSBs of each pixel is displayed for 1 time slice, whereas the bit-plane representing the MSBs is displayed for 2n/2 time slices. Because a time slice is only $33.3/(2^n-1)$ milliseconds, the SLM must be capable of loading the LSB bit-plane within that time. The time for loading the LSB bit-plane is the "peak data rate." U.S. Pat. No. 5,278,652, entitled "DMD Architecture and Timing for Use in a Pulse-Width Modulated Display System," assigned to Texas Instruments Incorporated describes various methods of addressing a DMD in a DMD-based display system. These methods are directed to loading data at the peak data rate. In one method, the time in which the most significant bit is displayed is broken into smaller segments so that loading for less significant bits can occur during these segments. Other methods involve clearing the display elements and using extra "off" times to load data.

Another method of solving the peak data rate problem is referred to as "memory multiplexing" or "split reset." This method uses a specially configured SLM, whose display elements are grouped into reset groups that are separately loaded and addressed. This reduces the amount of data to be loaded during any one time, and permits the LSB data for each reset group to be loaded at a different time during the frame period. This configuration is described in U.S. patent Ser. No. 08/300,356, entitled "Pixel Control Circuitry for Spatial Light Modulator", assigned to Texas Instruments Incorporated.

SUMMARY OF THE INVENTION

One aspect of the invention is a method of loading pixel data to memory cells of a spatial light modulator (SLM) having individually addressable display elements, for a pulse width modulated display. The data is received as a series of frames of data. Each frame is formatted into bit-planes, each bit-plane having one bit of data for each display element, and each bit-plane representing a bit-weight of intensity values to be displayed by the display elements, and each bit-plane having a display time corresponding to its bit-weight. The bit-planes are then divided into reset groups of data, each reset group representing data for a reset group of display elements connected to a common reset line. The memory cells of each reset group of display elements are loaded with reset groups of data, such that after the memory cells of one reset group are loaded with data of one bit-plane, different memory cells of a next reset group are loaded with other data of that bit-plane. Reset groups of display elements that are not currently being loaded can be reset (allowed to change state) while other reset groups are being loaded.

A technical advantage of the invention is that it provides a loading method that reduces the peak data rate by allowing simultaneous reset and loading operations. Less data is required to be loaded in one load cycle, as compared to "global reset" methods, in which the entire SLM array is loaded in one load cycle. Furthermore, bit-planes can be displayed for shorter times without loss of brightness that occurs when all display elements must be shut off while memory loading occurs. Finally, although it requires more memory cells than split reset methods, it does not require that reset groups be arranged in an interleaved pattern, which can lead to visual artifacts.

DETAILED DESCRIPTION OF THE INVENTION

Overview of SLM Display Systems Using PWM

A comprehensive description of a DMD-based digital display system is set out in U.S. Pat. No. 5,079,544, entitled "Standard Independent Digitized Video System," and in U.S. patent Ser. No. 08/147,249, entitled "Digital Television System," and in U.S. patent Ser. No. 08/146,385, entitled "DMD Display System." Each of these patents and patent applications is assigned to Texas Instruments Incorporated, and each is incorporated by reference herein. An overview of such systems is discussed below in connection with FIGS. 1 and 2.

Figure 1:
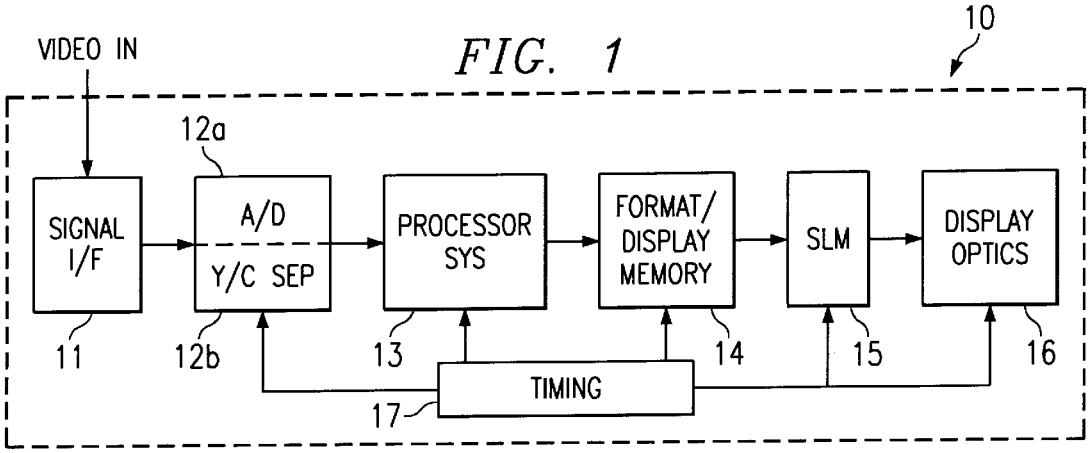
FIGS. 1 and 2 are block diagrams of image display systems, each having an SLM that is loaded with data in accordance with the invention.
Figure 2:
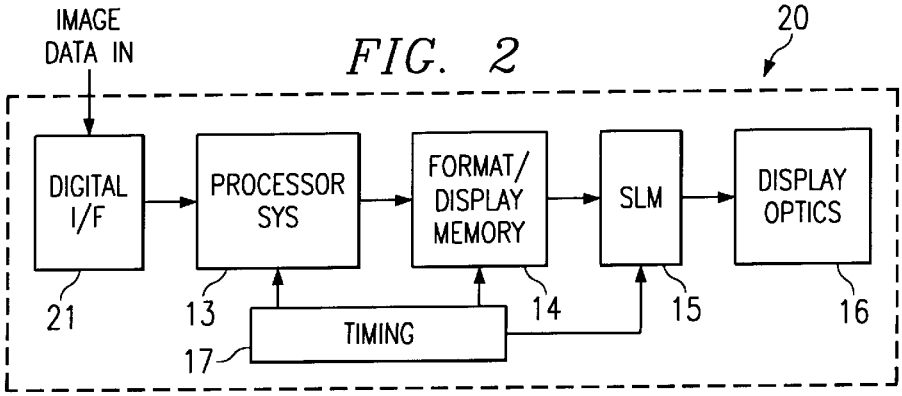

FIG. 1 is a block diagram of a projection display system 10, which uses an SLM 15 to generate real-time images from an analog video signal, such as a broadcast television signal. FIG. 2 is a block diagram of a similar system 20, in which the input signal already represents digital data. In both FIGS. 1 and 2, only those components significant to main-screen pixel data processing are shown. Other components, such as might be used for processing synchronization and audio signals or secondary screen features, such as closed captioning, are not shown.

Signal interface unit 11 receives an analog video signal and separates video, synchronization, and audio signals. It delivers the video signal to A/D converter 12*a* and Y/C separator 12*b*, which convert the data into pixel-data samples and which separate the luminance ("Y") data from the chrominance ("C") data, respectively. In FIG. 1, the signal is converted to digital data before Y/C separation, but in other embodiments, Y/C separation could be performed before A/D conversion.

Processor system 13 prepares the data for display, by performing various pixel data processing tasks. Processor system 13 may include whatever processing memory is useful for such tasks, such as field and line buffers. The tasks performed by processor system 13 may include linearization (to compensate for gamma correction), colorspace conversion, and interlace to progressive scan conversion. The order in which these tasks are performed may vary.

Display memory 14 receives processed pixel data from processor system 13. It formats the data, on input or on output, into "bit-plane" format, and delivers the bitplanes to SLM 15 one at a time. As discussed in the Background, the bit-plane format permits each display element of SLM 15 to be turned on or off in response to the value of 1 bit of data at a time. In the example of this description, this formatting is performed by hardware associated with display memory 14. However, in other embodiments, the formatting could be performed by processor system 13 or by dedicated formatting hardware in the data path before or after display memory 14.

In a typical display system 10, display memory 14 is a "double buffer" memory, which means that it has a capacity for at least two display frames. The buffer for one display frame can be read out to SLM 15 while the buffer another display frame is being written. The two buffers are controlled in a "ping-pong" manner so that data is continuously available to SLM 15.

The bit-plane data from display memory 14 is delivered to SLM 15. Although this description is in terms of a DMD-type of SLM 15, other types of SLMs could be substituted into display system 10 and used for the invention described herein. For example, SLM 15 could be an LCD-type SLM. Details of a suitable SLM 15 are set out in U.S. Pat. No. 4,956,619, entitled "Spatial Light Modulator," which is assigned to Texas Instruments Incorporated and incorporated by reference herein.

Essentially, SLM 15 uses the data from display memory 14 to address each display element of its display element array. The "on" or "off" state of each display element forms an image. In the embodiment of this invention, each display element of SLM 15 has an associated memory cell. As explained below in connection with FIGS. 3–5, this invention is directed to an SLM 15 especially configured for "divided reset".

Display optics unit 16 has optical components for receiving the image from SLM 15 and for illuminating an image plane such as a display screen. For color displays, the display optics unit could include a color wheel, and bit-planes for each color could be sequenced and synchronized to the color wheel. Or, the data for different colors could be concurrently displayed on multiple SLMs and combined by display optics unit 16. Master timing unit 17 provides various system control functions.

Divided Reset Addressing

Figure 3:
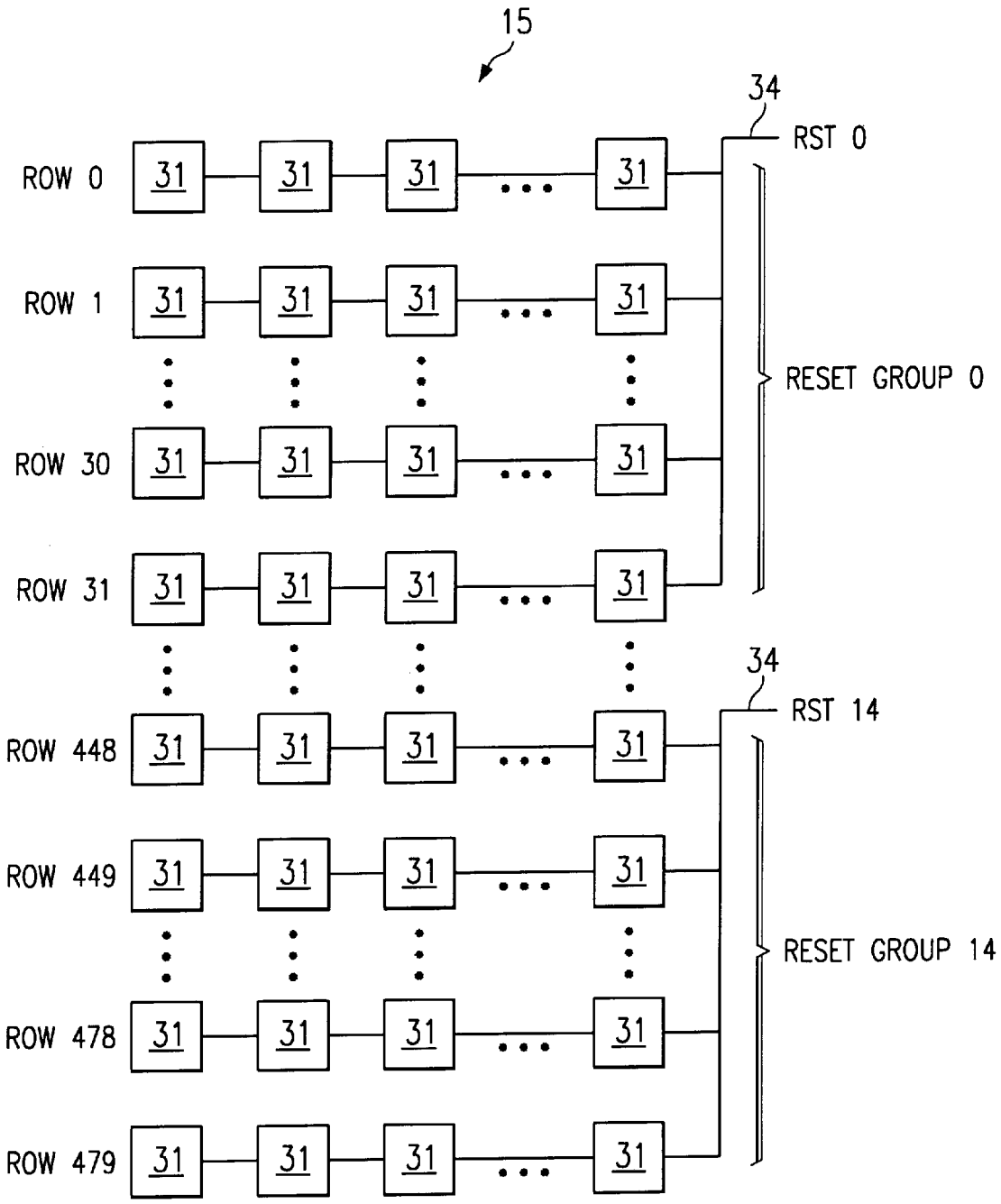
FIG. 3 illustrates the SLM of FIG. 1 or FIG. 2, configured for divided reset data loading.

FIG. 3 illustrates a portion of the display element array of SLM 15, configured for divided reset addressing. As explained below, addressing the display elements 31 requires that their memory cells be loaded with data and that they be reset to the appropriate position with each new set of data. Then, the display elements display the data by being on or off for the designated display time.

Only a small number of display elements 31 are explicitly shown, but as indicated, SLM 15 has additional rows and columns of display elements 31. A typical SLM 15 has hundreds or thousands of such display elements 31. As stated above, each display element 31 has a memory cell, so that there are as many memory cells as display elements 31.

SLM 15 is divided into "reset groups" of display elements 31, which are defined by which display elements 31 are connected to a single reset line 34. In the example of FIG. 3, each 32 consecutive rows of display elements 31 are connected to a single reset line 34, and thus these 32 rows of display elements are a reset group. If a 480 row SLM has 32 rows per reset group, there are 15 reset groups.

In other embodiments, SLM 15 could be partitioned into a lower array and an upper array. For example, where SLM 15 has 480 rows, each partition would have 240 rows and would be each loaded and addressed in parallel with the other. For a 480 row SLM having 16 rows per reset group, this would divide SLM 15 into 240/16=15 reset groups per partition.

The number of reset groups into which SLM 15 is arranged is somewhat arbitrary. In general, the minimum bit-plane display time is inversely proportional to the number of reset groups. On one hand, shorter bit times are desirable because they allow more light output and better flexibility for mitigating visual artifacts. On the other hand, overall complexity of the display system 10 or 20 increases with more reset groups because of the need for additional drive circuits, package pins, and control circuitry. In general, however, the principles described herein apply to a SLM 15 having any number of reset groups more than one.

The rows of each reset group need not be consecutive. Any pattern is possible, such as an interleaved pattern of every nth row for n reset lines. The pattern could be in vertical or diagonal rows. Furthermore, the pattern need not be row by row, and could be in blocks, contiguous or interleaved. However, experimentation indicates that visual artifacts are minimized for consecutive horizontal rows.

The data for the reset groups is formatted into reset group data. Thus, where p is the number of active display elements of the SLM 15 and q is the number of reset groups, a bit-plane having p number of bits is formatted into reset groups of data, each group having p/q bits of data.

As explained below, a feature of the invention is that data may be loaded, reset, and displayed in reset groups rather than in full bit-planes. This "divided reset" addressing permits short bit-plane display times without the need for black-out times, which are used to provide extra loading time for global reset methods, and without requiring shuffling of reset groups among bit-planes, which occurs in split reset methods, in which reset groups share memory cells.

Figure 4:
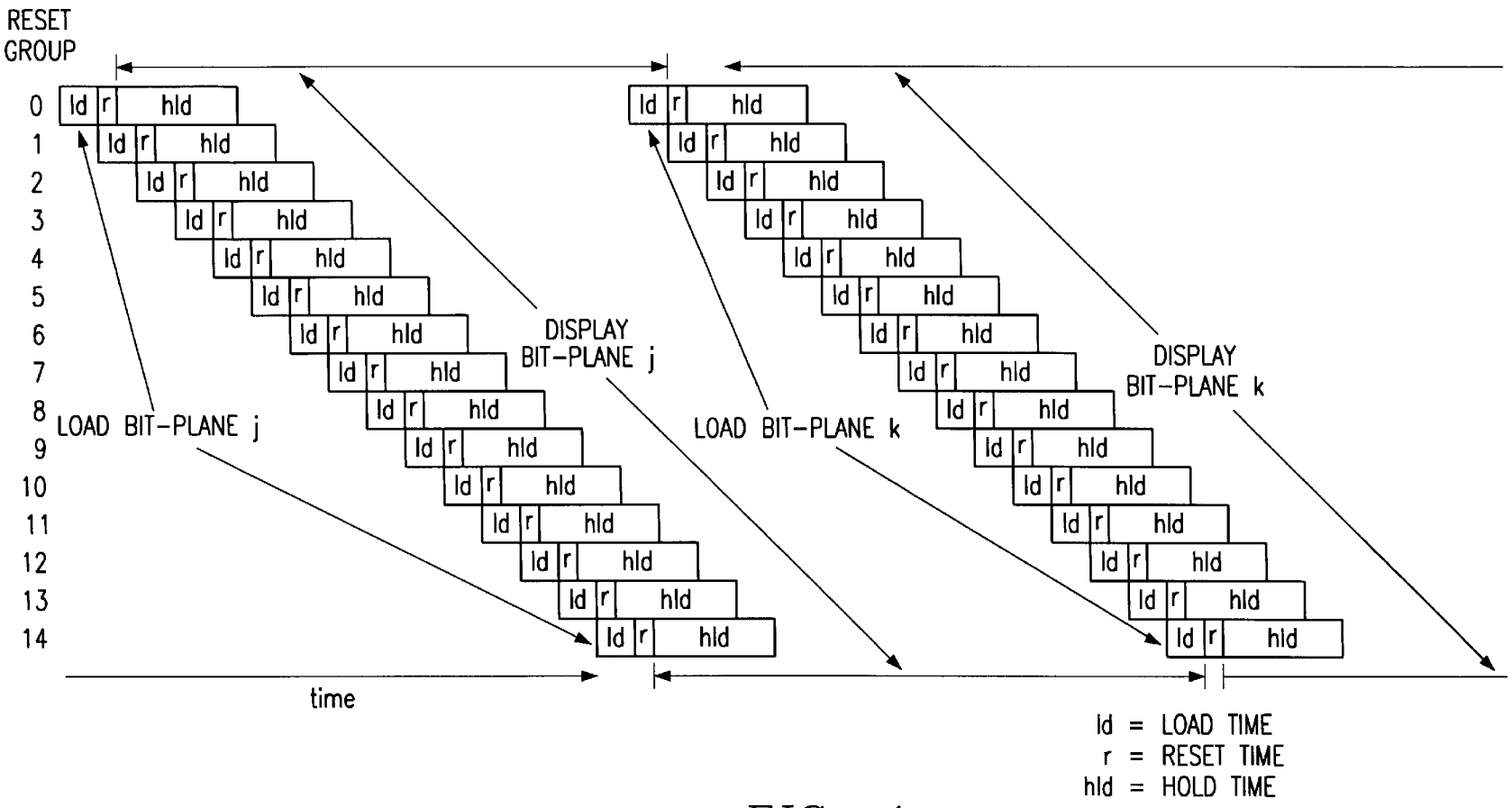
FIG. 4 illustrates how the reset groups of FIG. 3 are loaded for phased reset, where reset of a reset group occurs immediately after loading of that reset group.

FIG. 4 illustrates how the 15 reset groups of FIG. 3 are loaded and reset for display of a bit-plane. Each reset group is first loaded with data, during a load time, ld. Then, the display elements of this reset group are reset. The reset time, r, represents the time when a reset signal is applied on the reset line connected to that reset group. The reset signal causes each mirror in the reset group to change state in accordance with the data stored in its memory cell. After being reset, the reset group begins its display time. At the beginning of the display time, the display elements undergo a "hold" time, hld, during which the data must be stable.

After one reset group is loaded, the loading for the next reset group may begin. This loading, resetting, and displaying process is repeated for each of the 15 reset groups, such that after each reset group is loaded, the loading of the next reset group begins while the previous reset group is being reset and displayed.

In FIG. 4, each reset group is reset immediately after it is loaded, resulting in a "phased reset". As a result, the display times of the reset groups for the bit-plane are skewed at the beginning and end of the display time. However, the viewer perceives the display elements' "on" time nearly the same as if all display elements were on simultaneously for the bit time. The skew time is a total of the number of reset groups times the load time per reset group, which is a shorter skew time than can be achieved with split reset addressing.

FIG. 4 illustrates an address sequence where reset of each reset group occurs immediately after loading of that reset group. As a result, the bit-plane display time is at least as long as the total time to load all reset groups. In the particular example of FIG. 4, the bit-plane display time for bit-plane j, is the same as the time to load all reset groups—from the reset of Reset Group 0 to the reset of Reset Group 14. As explained below in connection with FIG. 5, the time between load and reset can be delayed for each reset group, which provides shorter display times, or loading can be non-continuous, which provides longer display times. Also, as explained below in connection with FIG. 6, the time between load and reset need not be the same among reset groups, which makes it possible to align the resets rather than skew them at the beginning of a bit-plane display time.

Figure 5:
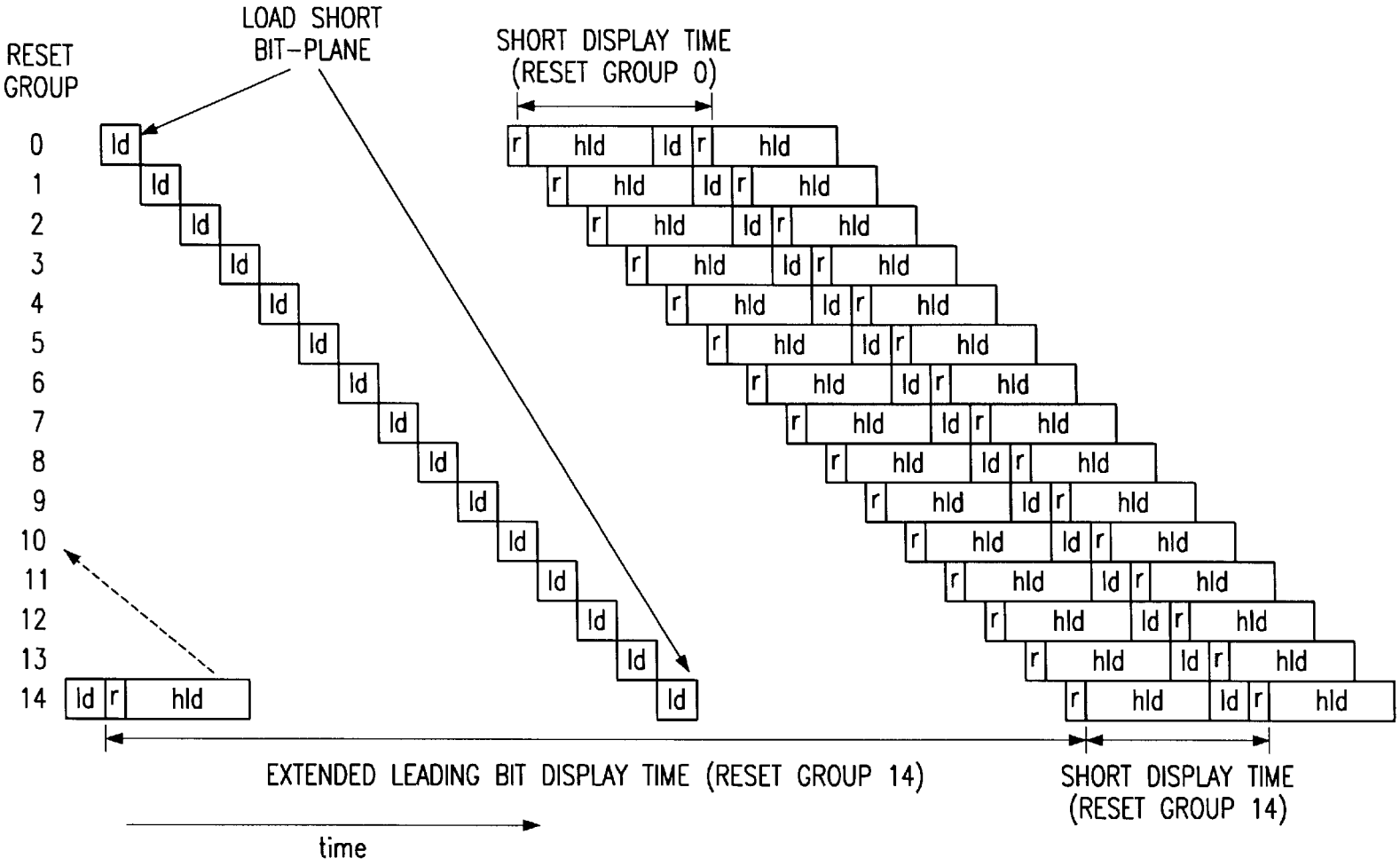
FIG. 5 illustrates how the reset groups of FIG. 3 are loaded for phased reset, where reset of all reset groups is delayed until after all reset groups are loaded.

FIG. 5 illustrates a variation of FIG. 4, for a "short bit-plane" display time. During addressing of that bit-plane, for each reset group, reset is delayed with respect to the load time. In other words, it is not necessary to the invention that loading of a reset group occur immediately before its reset—loading could occur any time during a previous display time, with reset delayed to reduce the display time. In FIG. 5, all loading of the short bit-plane occurs during a preceding bit-plane's display time. The time reset is delayed is added to the display time of the preceding bit-plane.

Referring to both FIGS. 4 and 5, a feature of the invention is that loading can be continuous from reset group to reset group. In other words, as soon as loading for one reset group ends, loading for a next reset group can begin. For any bit-plane, this continuous loading may occur for all reset groups, regardless of the weight of the bit-plane. This is in contrast to split reset addressing, where for a short bit-plane, addressing occurs at different times for each reset group. Also, when loading for one bit-plane ends, loading for the next bit-plane can begin without interruption. Continuous loading makes efficient use of available data bandwidth.

For continuous loading, the resets can be delayed until the next load encroaches upon the hold time, as in FIG. 5. In other words, when Reset Group 14 has been loaded with the short bit-plane data, it is time to start loading Reset Group 0 with a next bit-plane. The minimum display of the short bit-plane is the load time of the next bit-plane plus the reset and hold time of the short bit-plane. Referring to both FIGS. 4 and 5, for continuous loading, the reset could occur at any intermediate point between the zero delay of FIG. 4 or the maximum delay of FIG. 5, thereby selecting the bit-plane display time. Of course continuous loading is not a requirement of the invention, and longer bit planes can be provided by non-continous loading, either by delays between bit-planes or between reset groups.

The continous loading of short bits, as in FIG. 5, is possible because, unlike memory multiplexed SLMs, each reset group has its own memory cells. For any bit-plane, loading of each next reset group can occur before resetting of the previously loaded reset group. Also, unlike global reset groups, only the time to load one reset group is included in the display time of the short bit-plane. As indicated in the Background, global reset SLMs must either include the load time in the display time or darken the SLM during short-bit loading.

Figure 6:
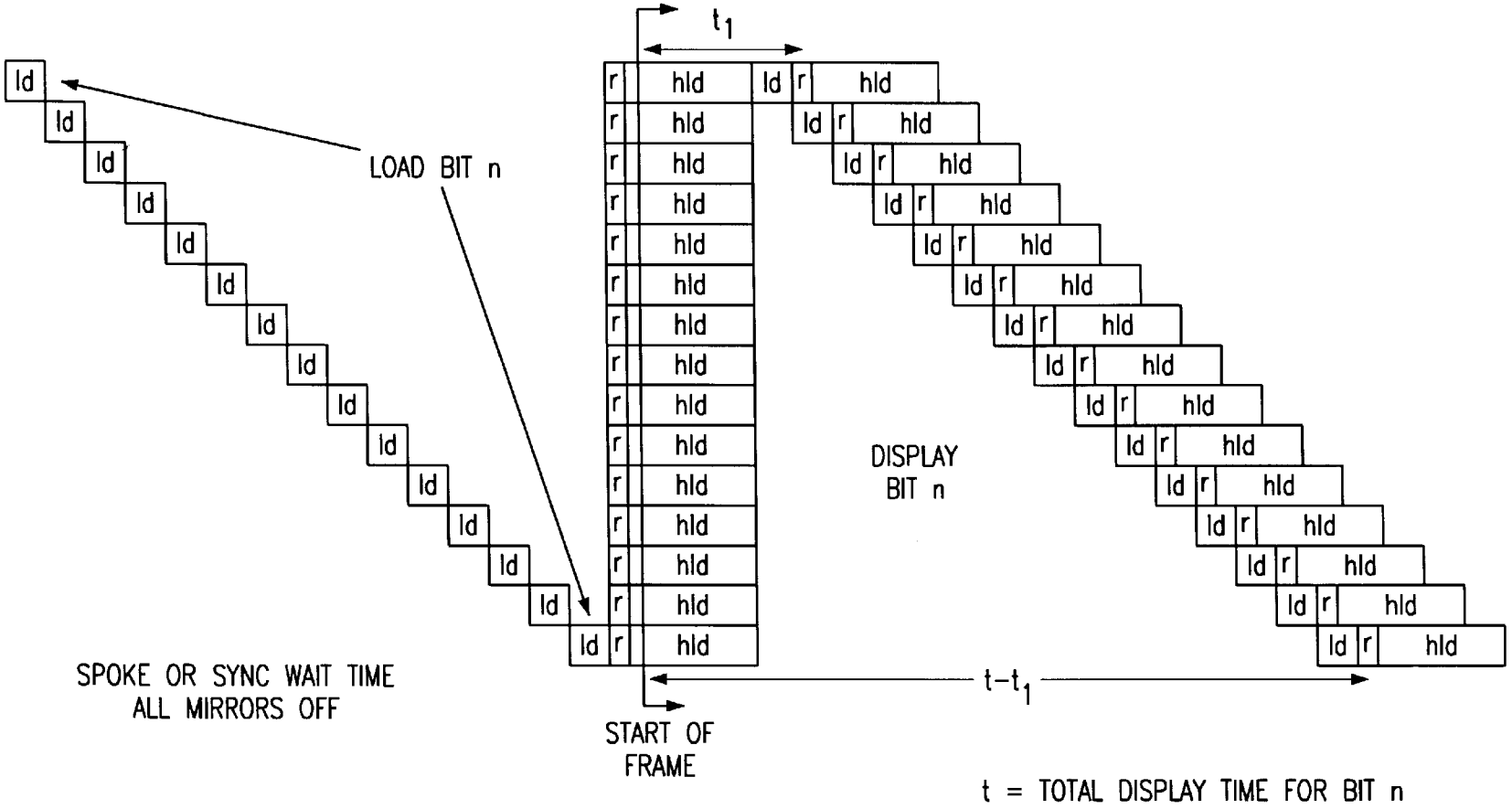
FIG. 6 illustrates how the reset groups of FIG. 3 are loaded for aligned reset.

FIG. 6 illustrates an "aligned" divided reset, as compared to the staggered divided reset of FIGS. 4 and 5. In FIGS. 4 and 5, each reset group was reset consecutively, resulting in staggered display times. In FIG. 6, loading for the reset groups occurs one after the other as in FIGS. 4 and 5. As in FIG. 5, the resetting of all reset groups is delayed with respect to the load times. However, all reset groups are reset at the same time, so that all reset groups for that bit-plane to begin their display times at the same time.

The aligned divided reset of FIG. 6 is especially useful at the beginning of an image frame. As explained above, an image frame is comprised of n bit-planes for n-bit pixel data. The first bit-plane to be displayed in a frame is reset simultaneously and the other bit-planes are reset sequentially. The reset groups of the first bit-plane have varying display times, but this can be compensated at the end of the frame by "splitting" the bit-plane into two segments, each having a display time that is a portion of the total display time, t. At the beginning of the frame, the first reset group has a display time of t1 and the last reset group has a display time of t-t1. At the end of the frame, the reset groups are reset sequentially, such that the first reset group has a display time of t-t1 and the last reset group has a display time of t1. The splitting can be achieved in other ways; there may be more than two segments and the segment sizes need not be symmetrical. Generally, the bit-plane selected for splitting will have a display time longer than the time to load all reset groups.

Other Embodiments

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A method of controlling a micromirror array, said array comprised of an array of individually controllable micromirror elements arranged in a plurality of reset groups, each of micromirror elements having a one-to-one correspondence with an array of memory cells, said method comprising the steps of:

loading a first portion of a bit plane of image data into said memory cells corresponding with a first reset group of said micromirror elements;

resetting said first reset group of said micromirror elements; and loading a second portion of a bit plane of image data into said memory cells corresponding with a second reset group of said micromirror elements during said resetting step.

2. The method of claim 1, said array of micromirror elements comprising an orthogonal array of elements arranged in rows and columns of elements such that each reset group is comprised a plurality of said rows of elements, each of said rows of elements in a given reset group contiguous to other said rows of elements in said given reset group.

3. The method of claim 1, said array of micromirror elements comprising an orthogonal array of elements arranged in rows and columns of elements such that each reset group is comprised a plurality of said rows of elements, each of said rows of elements in a given reset group interleaved with rows of elements in other reset groups.

* * * * *

UNITED STATES PATENT AND TRADEMARK OFFICE

CERTIFICATE OF CORRECTION

PATENT NO. : 6,201,521 B1
DATED : March 13, 2001
INVENTOR(S) : Donald B. Doherty It is certified that error appears in the above-identified patent and that said Letters Patent is hereby corrected as shown below:

Title page,
Insert Item [60], under Related U.S. Application Data

-- Provisional Application No. 60/004,584 Sep. 29, 1995. --

Signed and Sealed this

Seventeenth Day of December, 2002

JAMES E. ROGAN
*Director of the United States Patent and Trademark Office*